United States Patent [19]

Schneider

[11] Patent Number: 4,513,662

[45] Date of Patent: Apr. 30, 1985

[54] INK FOUNTAIN DIVIDING KEY

[75] Inventor: Georg Schneider, Würzburg, Fed. Rep. of Germany

[73] Assignee: Koenig & Bauer Aktiengesellschaft, Fed. Rep. of Germany

[21] Appl. No.: 542,945

[22] Filed: Oct. 18, 1983

[30] Foreign Application Priority Data

Nov. 6, 1982 [DE] Fed. Rep. of Germany ..... 3241124

[51] Int. Cl.[3] ..... B41F 1/46; B41F 31/18

[52] U.S. Cl. ..... 101/207; 101/363; 118/258; 118/407

[58] Field of Search ..... 101/207, 208, 210, 363, 101/364; 118/407, 258, 259, 410, 412

[56] References Cited

U.S. PATENT DOCUMENTS 907,638 12/1908 Page .
3,198,113 8/1965 Feller ..... 101/208
4,165,688 8/1979 Leanna et al. ..... 101/207

FOREIGN PATENT DOCUMENTS 1224328 3/1967 Fed. Rep. of Germany .
2093770 9/1982 United Kingdom ..... 101/207

*Primary Examiner*—Edgar S. Burr
*Assistant Examiner*—Moshe I. Cohen
*Attorney, Agent, or Firm*—Jones, Tullar & Cooper

[57] ABSTRACT

An ink fountain dividing key for use in an ink fountain of a rotary printing machine is disclosed. The ink fountain dividing key has a front face that is spaced from the peripheral surface of the ink fountain roller and which is curved with a radius of curvature the same as the radius of the ink fountain roller. A groove is formed on this curved front face of the key with the groove being supplied with compressed air at a pressure suitable to prevent ink flow from one side of the key to the other through the space between the key and the peripheral surface of the ink fountain roller.

4 Claims, 3 Drawing Figures

INK FOUNTAIN DIVIDING KEY

FIELD OF THE INVENTION

The present invention is directed generally to an ink fountain dividing key. More particularly, the present invention is directed to an ink fountain dividing key for use in an ink fountain of a rotary printing machine. Most specifically, the present invention is directed to an ink fountain dividing key for use with a rotary printing machine in which the ink fountain dividing key does not contact the ink fountain roller. The ink fountain roller may have either a smooth surface or may be a so-called screen roller that has a surface divided into a number of cells. The ink fountain dividing key has a face which is curved to the same radius as the fountain roller and which has a groove or recess. A suitable source of compressed air is delivered to the groove and acts to keep the inks on opposite sides of the dividing key separate without having the dividing key actually contact the fountain roller.

DESCRIPTION OF THE PRIOR ART

Ink fountains are generally well known in the art and act as a reservoir for printing ink which is supplied to the printing plates in a controlled manner. Typically, an ink fountain roller is used in the ink fountain and rotates into contact with the ink in the fountain so that a film of ink is formed on the ink fountain roller's surface. This ink is then transferred either directly or indirectly to the printing plates or formes.

The situation frequently arises in which either the entire length of the ink fountain roller does not need to be coated with ink due to a reduced size of the paper being printed, or in which it may be desirable to supply two different colors of ink from the same fountain. Either may be accomplished by using one or more ink fountain dividing keys. The use of such ink fountain dividing keys for use with a rotary printing machine is generally known in the art, as may be seen in German Pat. No. 1,224,328. A somewhat similar ink fountain dividing key may also be seen in U.S. Pat. No. 907,638. This patent discloses a key whose curved face is provided with a groove that can receive blotting paper or the like for the purpose of providing a good seal between the ink fountain dividing key and the surface of the ink fountain roller.

As can be appreciated by one of skill in the art, ink fountain dividing keys such as those disclosed in the prior art are not particularly suited for use with ink fountain rollers that rotate at high speeds or with ink fountain rollers of the screen or Anilox type; i.e., rollers having a surface divided into a number of small recesses or cells. The direct contact between the ink fountain dividing key and the smooth surfaced roller rotating at a high speed causes unacceptable wear to either the roller surface or the key. When the roller is a screen roller, leakage occurs since a positive seal cannot be obtained due to the non-uniform roller surface.

The use of packing materials such as is disclosed in the prior art U.S. Pat. No. 907,638 is also not satisfactory for the same reasons. Additionally, the use of such packing materials can introduce contaminants into the ink which may then be carried to the plates. It may thus be seen that a need exists for an ink fountain dividing key for use in an ink fountain of a rotary printing machine which provides satisfactory ink separation while being compatable with high ink fountain roller rotational speeds and with ink fountain rollers having a screen surface.

SUMMARY OF THE INVENTION

It is an object of the present invention to provide an ink fountain dividing key.

Another object of the present invention is to provide an ink fountain dividing key for use with a rotary printing machine.

A further object of the present invention is to provide an ink fountain dividing key which does not contact the surface of the ink fountain roller.

Yet another object of the present invention is to provide an ink fountain dividing key which can be used with a screen type ink fountain roller.

A still further object of the present invention is to provide an ink fountain dividing key that is shiftable longitudinally along the length of the ink fountain roller.

As will be set forth in greater detail in the description of the preferred embodiment, the ink fountain dividing key in accordance with the present invention has a front face which is curved with the same curvature as the ink fountain roller with which it cooperates. This front face includes a groove or recess which is closed at its ends and which communicates with a source of compressed air or another gas.

The pressure of the compressed air introduced into the grooved face of the ink fountain dividing key in accordance with the present invention acts to prevent any ink from flowing from one side of the dividing key to the other, thus accomplishing the purpose of ink separation in the fountain. Since the ink fountain dividing key of the present invention does not need to physically contact the ink fountain roller to attain ink separation, it is well suited for use with high speed ink fountain rollers as well as with ink fountain rollers having a screen type of surface. Further, since there is no contact between the key and the roller, there is no wear of either surface. As the ink fountain dividing key in accordance with the present invention does not use any packing material but relies instead on air pressure, there is no source of ink contamination.

The ink fountain dividing key in accordance with the present invention provides an ink fountain dividing means which does not wear the rollers and which is adaptable to different roller surfaces. The use of various ink compositions and colors in adjacent sections of the ink fountain is possible. Additionally, since the ink fountain dividing key in accordance with the present invention is shiftable along the length of the ink fountain roller, it is possible to vary the page width from a normal one page width to a double page width, as is used with panorama printing.

BRIEF DESCRIPTION OF THE DRAWINGS

While the novel features of the ink fountain dividing key for an ink fountain of a rotary printing machine in accordance with the present invention are set forth with particularity in the appended claims, a full and complete understanding of the invention may be had by referring to the detailed description of a preferred embodiment, as set forth hereinafter and as may be seen in the accompanying drawings in which:

DESCRIPTION OF THE PREFERRED EMBODIMENT

Figure 1:
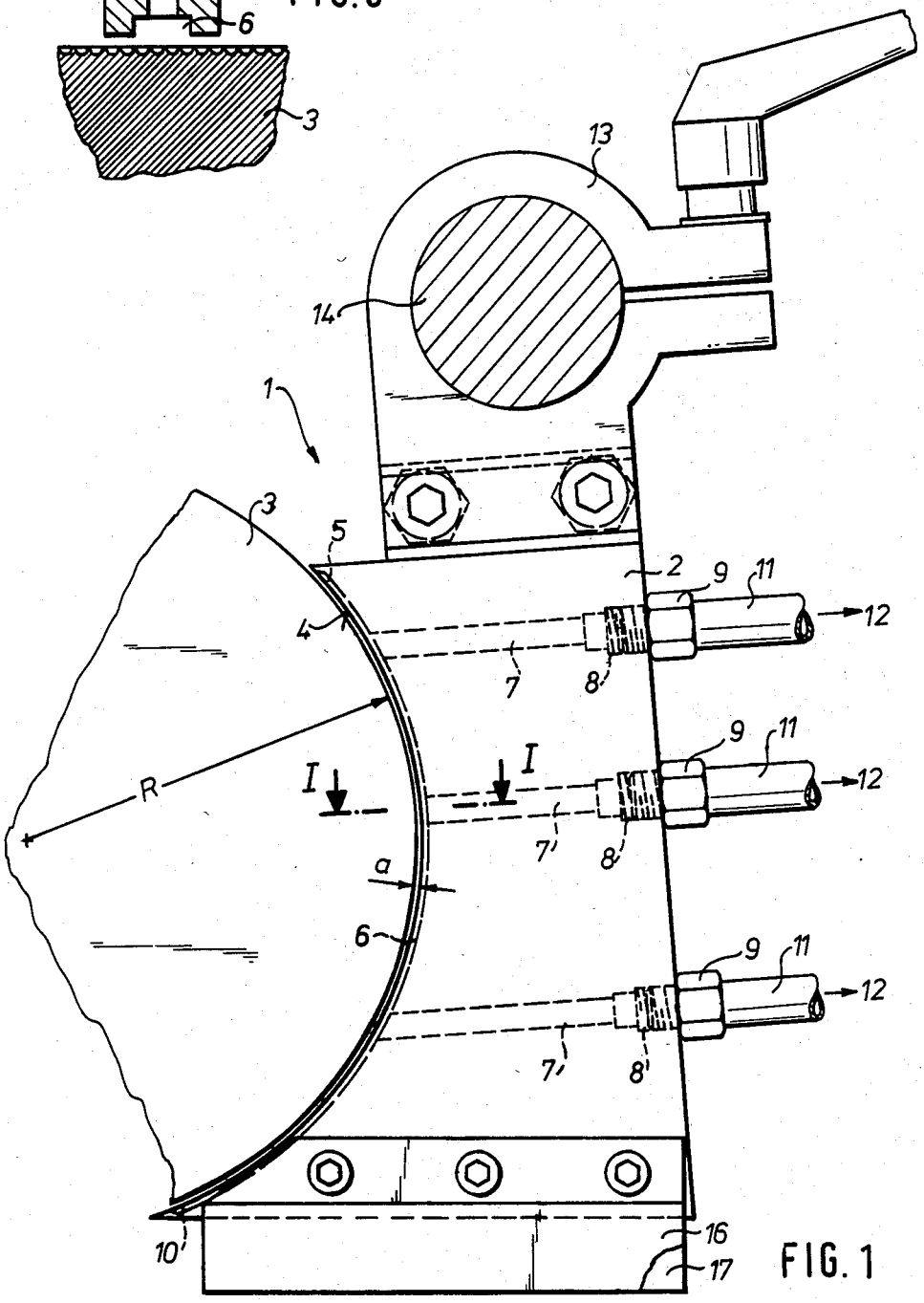
FIG. 1 is a schematic side elevational view, partly in section of the ink fountain dividing key in accordance with the present invention.

Turning initially to FIG. 1, there may be seen, generally at 1, an ink fountain of a rotary printing machine in accordance with the present invention. An ink fountain dividing key, generally at 2, is supported in ink fountain 1 and serves to divide the ink fountain into several compartments. It will be understood that only one or a plurality of ink fountain dividing keys can be used, depending on the number of compartments the ink fountain 1 is to be divided into. An ink fountain roller 3 is positioned in ink fountain 1 and is rotatably supported by the side frames (not shown) in a conventional manner. Ink fountain roller 3 is driven in a known manner and rotates at a peripheral speed that is the same as the speed of the paper being printed. Ink fountain roller 3 may either have a smooth outer surface or may be a screen or Anilox roller, in which case the surface of roller 3 has a plurality of cells or recesses.

Figure 3:
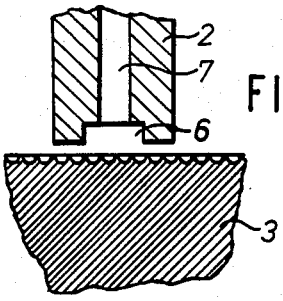
FIG. 3 is a sectional view of a portion of the ink fountain dividing key and ink fountain roller taken along line I—I of FIG. 1.

Ink fountain dividing key 2 has a front face 4 which, in the preferred embodiment, has a width of approximately 10 mm and which is curved to correspond to the radius R of the ink fountain roller 3. A groove 6, which may also be seen in FIG. 3, is formed in front face 4 of ink fountain dividing key 2. This groove is, in the preferred embodiment, approximately 6 mm wide and 2 mm deep and is spaced in the middle of front face 4 of key 2. Groove 6 is closed at its upper end 5 and at its lower end 10, as may be seen in FIG. 1.

A plurality of generally straight bore holes 7 extend through the body of ink fountain dividing key 2 and terminate at first ends in groove 6, as shown in FIGS. 1 and 3. The second ends 8 of bores 7 terminate at flexible tube connections 9 positioned on the rear face of key 2. Flexible tubes 11 are secured to tube connections 9 and communicate with a suitable compressed air source 12 which is not specifically shown in the drawings.

The front face 4 of ink fountain dividing key 2 is positioned at a distance "a" the peripheral surface of the ink fountain roller 3. In the preferred embodiment, this distance "a" is approximately 0.01 mm. The positioning is accomplished by a clamping device 13, which may be seen in FIGS. 1 and 2. The clamping device 13 secures the ink fountain dividing key to a spindle 14 that is carried in the side frames. By use of clamp 13, each ink fountain dividing key 2 can be moved longitudinally along the length of the ink fountain roller 3.

Figure 2:
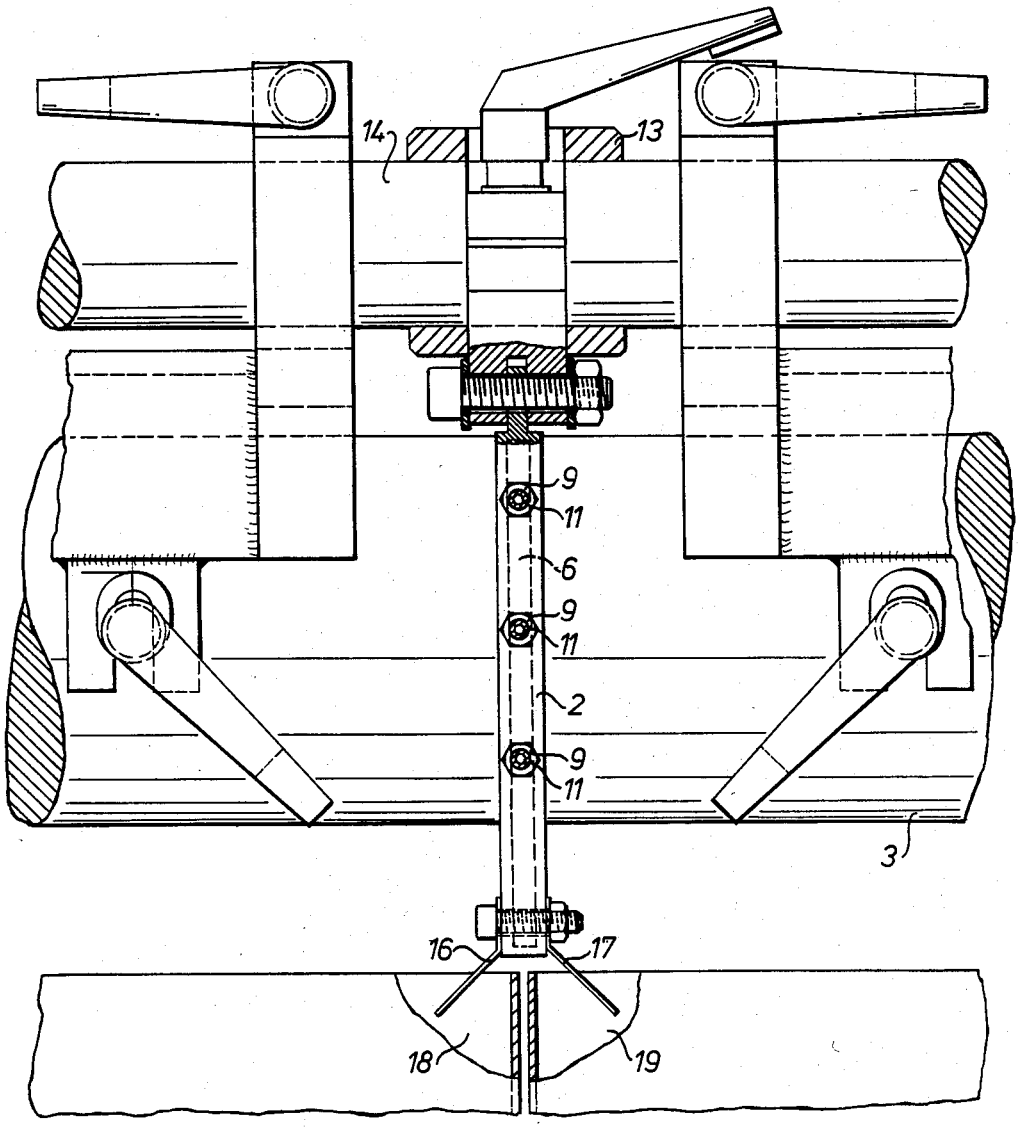
FIG. 2 is a schematic front elevational view of the ink fountain dividing key in accordance with the present invention.

Each ink fountain dividing key 2 is provided with a pair of downwardly and outwardly extending ink diverting metal sheets 16 and 17, which may be secured to the lower portion of the key, as is seen in FIGS. 1 and 2, by any suitable means. These ink diverting metal sheets 16 and 17 act to divert surplus printing ink into ink containers 18 and 19.

In use, ink fountain dividing key 2 is positioned along ink fountain roller 3 by being slid along spindle 14 and then being held in place by use of clamp 13. Compressed air or another compressed gas is fed from the compressed air source 12 through flexible tubes 11 and through bores 7 to the groove 6 in the front face 4 of key 2. The pressure of the compressed air is controlled by any suitable means so that it will be sufficient to prevent ink from passing between roller 3 and ink key 2 while not being unnecessarily high. Thus the ink fountain dividing key 2 in accordance with the present invention provides a means for separating the inks in the fountain while not causing ink fountain roller wear and while allowing the use of screen rollers.

While a preferred embodiment of an ink fountain dividing key in accordance with the present invention has been fully and completely set forth hereinabove, it will be obvious to one of skill in the art that a number of changes in; for example, the number of bore holes, the dimensions of the key, the compressed air source, the type of clamp assembly, and the like, could be made without departing from the true spirit and scope of the subject invention which is accordingly to be limited only by the following claims.

I claim:

1. An ink fountain dividing key for use in adjustably separating the surface of an ink fountain roller of uniform radius rotatable in an ink fountain of a rotary printing machine into a plurality of longitudinally spaced, separate ink applying surfaces, said ink fountain dividing key comprising:

a body having a curved front face, said curved front face having a radius of curvature the same as the uniform radius of the ink fountain roller disposed in the ink fountain, said curved front face being positioned closely adjacent and spaced from the surface of the ink fountain roller and being shiftable along the longitudinal length of the ink fountain roller;

a groove generally in the middle of said front face, said groove extending along said curved front face generally perpendicular to the longitudinal surface of the ink fountain roller and being closed at upper and lower ends of said curved front face;

a plurality of bore holes extending through said body of said ink fountain dividing key and terminating in said groove;

means for supplying compressed air to said groove through said bore holes, no part of said dividing key contacting said roller at any location said compressed air being the sole means contacting said roller to separate the surface of the ink fountain roller into separate ink applying surfaces; and means for shifting said ink fountain dividing key longitudinally along the length of the ink fountain roller.

2. The ink fountain dividing key of claim 1 wherein said ink fountain dividing key includes at least one ink diverting metal sheet secured on a lower extremity of said body of said key.

3. The ink fountain dividing key of claim 1 wherein said shifting means includes a clamp means secured to said body of said key.

4. The ink fountain dividing key of claim 3 wherein said clamp means engages a spindle.

* * * * *